United States Patent [19]

Worth

[11] Patent Number: 4,483,442

[45] Date of Patent: Nov. 20, 1984

[54] PACKING TRAY FOR FLAT CABLE CONDUCTORS HAVING LATCHABLE COVERS

[75] Inventor: Sidney V. Worth, Flourtown, Pa.

[73] Assignee: Continental-Wirt Electronics Corp., Southampton, Pa.

[21] Appl. No.: 553,231

[22] Filed: Nov. 18, 1983

[51] Int. Cl.[3] ..... B65D 73/02; B65D 85/42

[52] U.S. Cl. ..... 206/334; 206/480; 206/558; 206/560; 206/561; 206/564; 206/328

[58] Field of Search ..... 206/328, 334, 558, 560, 206/561, 562, 563, 564, 566, 480, 483, 565

[56] References Cited

U.S. PATENT DOCUMENTS

| | | | |
|---|---|---|---|
| 3,467,242 | 9/1969 | De Rousse | 206/334 |
| 3,607,440 | 9/1971 | Fred et al. | 206/334 |
| 3,609,821 | 10/1971 | McMillan, Jr. | 206/328 |
| 4,322,702 | 3/1982 | Bosch | 206/328 |
| 4,323,155 | 4/1982 | Kung | 206/328 |
| 4,359,157 | 11/1982 | Horstmann | 206/328 |

*Primary Examiner*—Joseph Man-Fu Moy

*Attorney, Agent, or Firm*—Ostrolenk, Faber, Gerb & Soffen

[57] ABSTRACT

A tray having a plurality of parallel troughs is made from vacuum-formed polystyrene. Each of the troughs contains a pair of side walls, with adjacent walls of adjacent troughs connected together by respective flat, elongated ledges. The periphery of the tray is surrounded by a flat flange which is parallel to the ledges. The length of the troughs is greater than the length of two or more individual conductors which are side-mounted within the troughs. The width of the troughs corresponds to the combined height of a connector with its flat cover loosely fitted thereon and not fully latched to the body of the connector. The depth of the tray corresponds approximately to the width of the connector. Embossment projections are formed in the flat bottoms of the troughs and project into the space between the body of the connector and its loosely mounted cover. The projections are spaced from one another in any desired manner and preferably are non-equally spaced so that they will fit into the gaps between cover and body of different length connectors of the same type. The trough walls adjacent the projections have arcuate depressions to improve the molding of the embossed projections. Various types of connectors can be mounted in the tray including D type connectors and printed circuit board connectors.

12 Claims, 10 Drawing Figures

(STORAGE POSITION)

PACKING TRAY FOR FLAT CABLE CONDUCTORS HAVING LATCHABLE COVERS

BACKGROUND OF THE INVENTION

This invention relates to packaging trays for electrical connectors which make connection to flat multi-cable conductors, and more specifically relates to a novel inexpensive tray for preventing accidental latching of the connector covers to the connector body during the storage and shipment of the connectors.

Electrical connectors for making connection to flat multi-conductor cables are well known. Typically, such connectors consist of a main insulation body which has contacts operable to pierce the insulation covering of a multi-conductor cable so that the contacts engage respective wires of the cable. A cover telescopes over the ends of the connector body and is latched to the sides of the body in order to cover the cable after the cable has been pierced by the various contacts of the body.

Preferably the covers are loosely mounted on their respective bodies so that the two parts will always be available to the user. During the shipment of such connectors and while they are stored prior to use, it is possible that the covers will be forced down onto the body and into a fully latched position. In order to use the cover, it then becomes necessary to pry the latches apart and remove the cover as that the multi-conductor cable can be applied to the contacts of the body by an appropriate tool and the cable thereafter covered by the latchable cover. During this process, the cover latching portions are often broken and it is a time-consuming process to remove the cover after it has been accidentally latched.

BRIEF DESCRIPTION OF THE INVENTION

In accordance with the present invention, a novel tray structure is provided for supporting flat multi-cable connectors with their covers loosely held or loosely matched in position and for preventing the accidental compression of the cover to its fully latched position on the connector body. The novel tray of the invention is preferably formed of polystyrene formed in a vacuum-forming operation and consists of a plurality of parallel troughs, each of which is dimensioned to have a depth equal to the width of the connector to be received in the trough, and a width equal to the dimension from the bottom of the connector body to the top of a loosely held cover therefor. Consequently, accidental compression of the cover into a fully latched position with the body is prevented for connectors loaded in the tray troughs.

A plurality of embossments are formed in the bottoms of the troughs and project into the gap between the connector body and the cover. These projections prevent movement of the connectors along the length of the trough and further prevent the accidental compression of the cover onto the body. Preferably, the embossments are non-equally spaced to ensure the presence of a latching embossment between connector body and cover to prevent longitudinal movement of a connector in a trough even though connectors of varying widths are stacked along the length of the trough. The dimensions for the trough are selected so that the connectors will be snugly fit within the troughs, thereby preventing rattling and motion of the housed connectors.

The vacuum-formed tray is inexpensive and is provided with ledges between adjacent troughs and a peripheral surrounding flange or ledge which is in the same plane as the ledges between troughs. This, along with the trough configuration, provides a strong, relatively inflexible structure for the trays. The use of polystyrene or other plastics will not affect the precious metal plating used for the connector contacts and conductors.

The walls of the troughs can be at a slight angle to one another to enable nesting of trays. The walls are also provided with slots which extend generally perpendicularly from the base and in alignment with the embossed projections in the base of the trough. These slots permit improved molding of the tray and prevent the formation of webs between the embossed projections and the adjacent trough side wall.

DETAILED DESCRIPTION OF THE INVENTION

Figures 1, 2, 3, 4, 5:
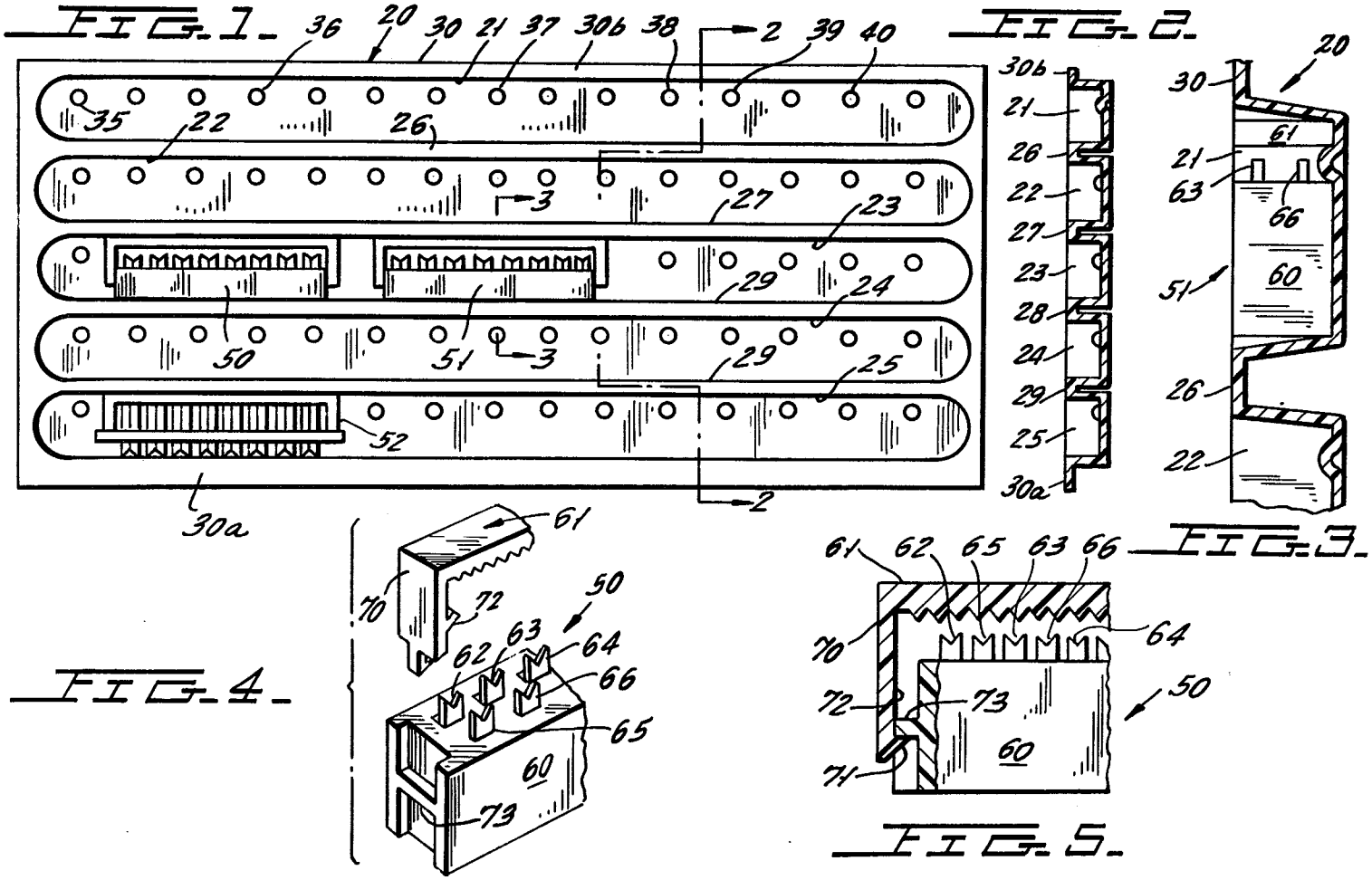
FIG. 1 is a plan view of a tray made in accordance with the invention, showing two different types of connectors in place in two of the troughs.
FIG. 2 is a cross-sectional view of FIG. 1, taken across the section line 2—2 in FIG. 1.
FIG. 3 is a cross-sectional view of FIG. 1, taken across the section line 3—3 in FIG. 1 and schematically illustrates one of the connectors which is in place within the trough.
FIG. 4 is an exploded perspective view of one end of a connector having a body and cover member.
FIG. 5 is a view partly in cross-section of the assembled cover and body of FIG. 4 and illustrates the connector in its partially latched position.

Referring first to FIGS. 1, 2 and 3, there is shown therein a tray 20 formed preferably of a thin polystyrene in a vacuum-forming process of well-known type. Other plastic materials, preferably those which are unreactive relative to the plating used for the connectors which will later be described, can also be used.

The tray shown in FIGS. 1 and 2 contains five troughs 21–25 which are joined to one another by integral ledges 26, 27, 28 and 29 which join adjacent sides of adjacent troughs. The outer periphery of the tray 20 contains a flange or surrounding ledge 30 which is in the plane of the ledges 26–29.

The troughs 21–25 can have any desired length, for example, 10 inches, or as long as desired for storage of one or more connectors. The troughs may also have any desired depth, for example, ¼ inch. The exact depth is preferably approximately the same as the width of the connector which is to be laid on its side within a trough, as will be later described.

The width of each trough which, in the preferred embodiment, is about $\frac{5}{8}$ inch, will be determined by the height of the connector to be mounted therein with its loosely mounted cover in place. Each of the ledges 26–29 and flange 30 may have a width of about 3/16 inch.

In the preferred embodiment of the invention, the bases of each of troughs 21–25 are flat bases and contain, at a location closer to the upper side wall of each trough in FIG. 1 than to the lower side wall of the trough, a line of embossed projections such as projections 35–40. Projections 35–40 may have a diameter of about $\frac{1}{8}$ inch and a depth of about $\frac{1}{8}$ inch. Preferably the projection diameter will equal the space between the cover and base to be described and the height does not reach the contacts to be described and which project from the base. Preferably, the projections are not equally or symmetrically spaced so that they can accommodate various lengths of connectors which are laid end-to-end within a given trough.

In FIG. 1, two connectors 50 and 51 are shown disposed in trough 23 and a connector 52 is shown disposed in trough 25. Connector 50 is shown in more detail in FIGS. 4 and 5 and connector 52 is shown in detail in FIGS. 6 and 7.

Referring to FIGS. 4 and 5, the connector 50 consists of an insulation body 60 and a cover 61. The body 60 is of conventional structure and has a plurality of contacts extending from one flat side thereof shown as contacts 62–66 arranged in two rows, as shown. Any desired number of contacts are provided in the two rows. The contacts have a configuration such that they can pierce the insulation sheath of a flat multi-conductor cable so that each contact will engage the respective conductive wire within the conductive sheath. Each of the piercing contacts 62–66 is connected to contact portions which are accessible at the bottom end of body 60 (not shown) and can be of any desired well-known form, such as a simple connection wire or an integral clip, which can be connected to any desired plug-in type of connection arrangement.

After the multi-connector cable (not shown) is connected to the contacts of the body 60, the connector cover 61 is pressed over the top of the cable and is latched to the connector body. The latching structure consists of leg sections extending from the opposite ends of the connector cover 61 including the leg 70 and an identical leg (not shown) at the other end of the cover 61. Leg 70 is of the type having a double latch system including a first latch projection 71 and a second latch projection 72.

Leg 70, although it is thin and fragile, is sufficiently flexible that when the cover 61 is forced in place, the latch 71 will cam over the cooperating latch member 73 in the side of body 60. A similar latch at the other side of the body 60 receives the latches on the other end of cover 61. The cover 61 is then loosely latched to the body 60, but can be easily removed therefrom for attaching the cable to body 60. Once the cable is attached, cover 61 is telescoped further over the body 60, so that the latch 72 will cam over the latch member 73 to firmly attach cover 61 in place.

In the fully latched position, it is very difficult to remove the cover 61 from the body 60. It is desirable, however, to loosely latch or locate the cover to its associated body rather than shipping the elements separately, leading to the danger that the user may have available only bodies but no covers, or vice-versa. However, in the past, when the connectors were shipped with covers over the bodies, there was a danger of having the covers pressed into their fully latched position where the latch 72 latches under the latch member 71.

In accordance with the present invention, the connectors 50 and 51, shown in FIGS. 4 and 5, can be contained in the tray of FIGS. 1, 2 and 3 so that they are completely protected against full compression even though the cover is loosely latched to the body. Note particularly in FIG. 3 that the trough depth is approximately equal to the width of the connector 50 and that the height of the combined connector and cover is approximately equal to the width of the trough.

Note also that when the connectors 50, 51 and 52 are mounted in their respective troughs, the projections, such as projections 35–40 in each trough will extend into the gap between the open cover and the body of the connector. Moreover, these projections will prevent the motion of the connector along the length of the trough if the trough is not filled with connectors.

Figures 6, 7, 8, 9, 10:
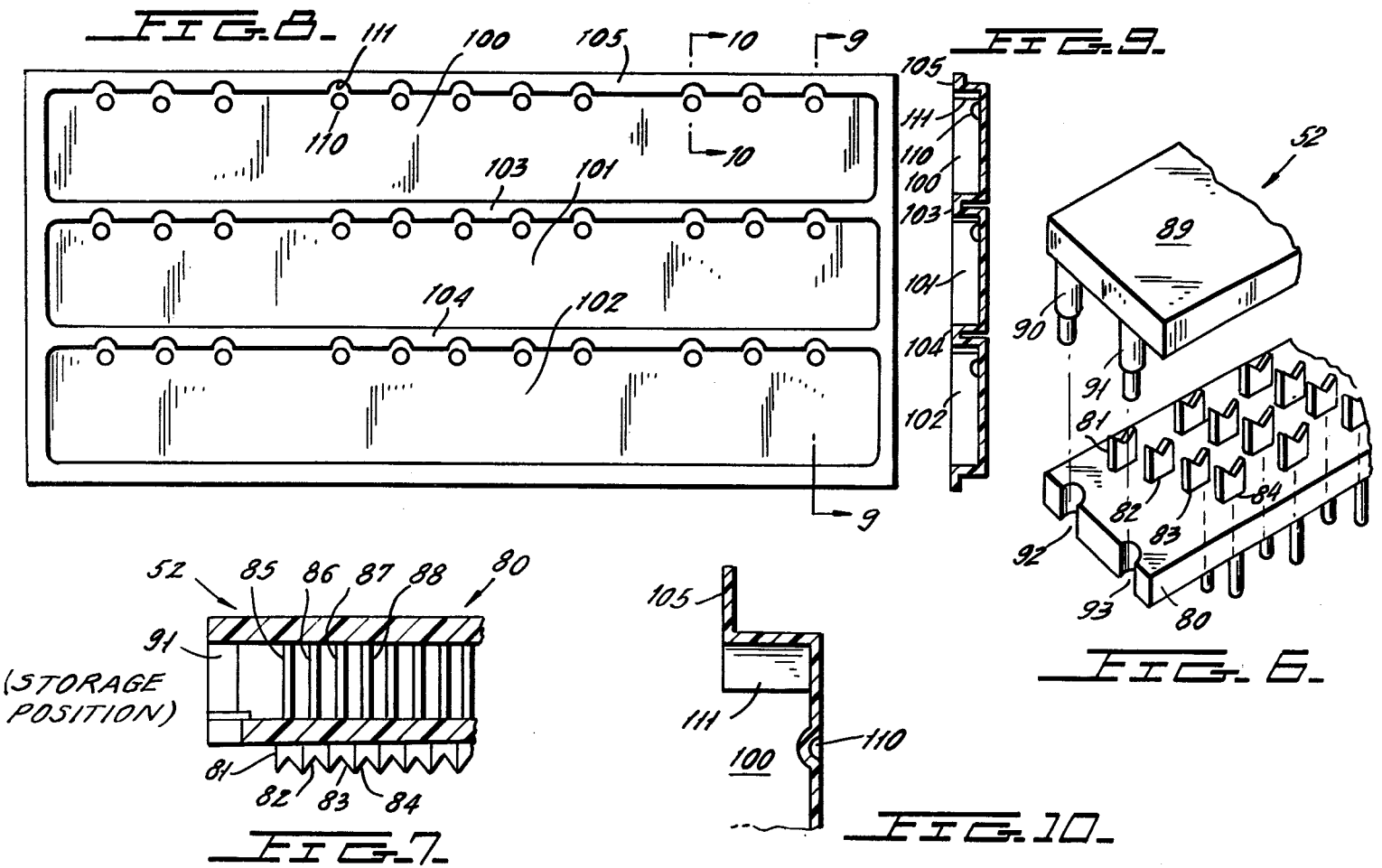
FIG. 6 is an exploded perspective view of one end of a connector of different structure than that shown in FIGS. 4 and 5.
FIG. 7 shows the connector of FIG. 6 in partial cross-sectional view with the cover in the unlatched position used for storage in the tray.
FIG. 8 is a plan view of a connector structure of different configuration than that shown in FIG. 1 and shows slots adjacent the embossed projections in the trough bottom and a different number of troughs and different dimension troughs than that of FIG. 1.
FIG. 9 is a cross-sectional view of FIG. 8, taken across the section line 9—9 in FIG. 8.
FIG. 10 is an enlarged cross-sectional view of FIG. 8 taken across section line 10—10 in FIG. 8.

Any type of connector structure having a cover can be mounted as shown for the connectors 50 and 51. For example, the connector 52 of FIG. 1 is a printed circuit board connector which is shown in more detail in FIGS. 6 and 7. The printed circuit board connector of FIGS. 6 and 7 consists of a base 80 having four rows of cable piercing contacts such as contacts 81–84 which, as shown in FIG. 7, have extending conductors 85, 86, 87 and 88, respectively, which are embedded in the insulation body 80. The diameter of the ends of legs 90 and 91 may be reduced in diameter for a loose initial fit into openings 92 and 93, as shown.

After the contacts such as contacts 81–84 are connected to respective conductors of a multi-conductor cable, a cover 89 is forced over the cable and the cover legs 90 and 91 are force-fit into cooperating openings 92 and 93, respectively, in the base 80 to fix the cover in place. A similar arrangement exists on the opposite end of cover 89 and body 80. Once the legs 90 and 91 are pressed into openings 92 and 93, it is difficult to thereafter remove the cover 89 from the body 80. The diameter of the ends of legs 90 and 91 may be reduced for a loose initial fit into openings 92 and 93 as shown.

In accordance with the invention, the base 80 of FIG. 6 is inverted and the cover 89 is telescoped over the extending contact legs 85–88 when the connector is to be shipped. Thus, the latching posts 90 and 91 cannot be pressed into openings 92 and 93. However, the loosely connected body 80 and cover 89 can be loaded into the close-fitting trough 25 in FIG. 1 so that the cover and body can be safely shipped or stored without the cover being accidentally compressed into engagement with the body. If desired, however, the base 80 and cover 89 can be loosely mounted in their operative positions. Note also that projections, such as projections 35 to 40, are not needed for connectors, such as connector 52.

The tray of FIGS. 1, 2 and 3 will, of course, take the dimensions determined by the particular conductors which are to be shipped and different numbers of troughs can be employed. For example, as shown in FIGS. 8, 9 and 10, a tray structure is shown containing only three troughs 100, 101 and 102. Two central ledges 103 and 104 are provided along with an outer surrounding ledge 105 for purposes of reinforcing the tray body.

As shown in FIGS. 8–10, there are provided a plurality of projections in the bases of the troughs shown, for example, as the projection 110. The side wall of the trough closest to the projections is then provided with a plurality of integral slots such as slot 111 adjacent projection 110. The slot 111 increases the distance between the projection 110 and the adjacent portion of the wall at the base of trough 100 to prevent the formation of a web of plastic material between the wall and the projection during the vacuum-forming process. Such webs would prevent the flush mounting of connectors onto the bottom of the trough.

In order to stack loaded trays atop one another, the trays are preferably asymmetrical about a line through the center of the trays which is parallel to the direction of elongation of the slots. The asymmetry is obtained as shown in FIGS. 1 and 2 by making side edge 30*a* wider than side edge 30*b*. When loaded, stacked trays are placed atop one another and are rotated 180° relative to one another so that the flat bottoms of each trough rest on respective underlying flat ledges, such as ledges 26 to 29.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A tray for supporting electrical connectors which are connectable to flat, multi-conductor cable; said electrical connectors each comprising: an elongated insulation body of rectangular section, one side of said body having a generally flat surface having spaced contacts, adapted for piercing the insulation sheath of a flat multi-conductor cable and making engagement with respective conduction of said cable, the other side of said body having respective electrical conductors connected to respective ones of said contacts, said conductors being accessible for connection at said other side of said body; a cover member having a flat cover section and a pair of legs extending from the opposite ends of said cover member and disposed in spaced parallel planes which are perpendicular to the plane of said flat cover section; and first latch means on said pair of legs and cooperating second latch means on said body, said first and second latch means being engageable for latching said cover member to said body and in a position for holding a flat cable conductor pressed between said one side of said body and the interior opposing surface of said cover member; said tray comprising a thin plastic-molded sheet having a plurality of parallel troughs; each of said troughs comprising a flat base and a pair of upstanding walls extending from said base; the depth of each of said troughs being substantially equal to the thickness of said body and of said cover member; the length of said troughs being greater than the length of at least one of said connectors; the width of said troughs being equal to the distance between the free end of either said contacts or said conductors, and the outer surface of said cover member when said cover member is placed over said body but is sufficiently spaced therefrom that said first and second latch means are not engaged, whereby said connectors are protected against the accidental engagement of said first and second latch means while they are in said tray.

2. The tray of claim 1, wherein said flat bases of each of said troughs have a line of a plurality of spaced embossed projections projecting therefrom, and extending into the gap between the interior surface of said cover member and said side of said body; said projections preventing the movement of said connectors along the length of said trough.

3. The tray of claim 1 which includes respective thin flat elongated ledges connecting the adjacent sides of said parallel troughs.

4. The tray of claim 2 which includes respective thin flat elongated ledges connecting the adjacent sides of said parallel troughs.

5. The tray of claim 4, wherein said sides of said troughs having a plurality of arcuate sections extending perpendicularly from their respective base and aligned with respective ones of said embossed projections; said arcuate sections having axes which are perpendicular to said bases.

6. The tray of claim 3, wherein said tray has a flat reinforcement ledge extending around the periphery thereof; said reinforcement ledge being parallel to said ledges disposed between the adjacent sides of said troughs.

7. The tray of claim 4, wherein said tray has a flat reinforcement ledge extending around the periphery thereof; said reinforcement ledge being parallel to said ledges disposed between the adjacent sides of said troughs.

8. The tray of claim 5, wherein said tray has a flat reinforcement ledge extending around the periphery thereof; said reinforcement ledge being parallel to said ledges disposed between the adjacent sides of said troughs.

9. The tray of claim 4, wherein said tray is asymmetric about a central line which extends parallel to said trough and said flat ledges act as stand-off surfaces when stacking identical trays atop one another.

10. A tray for supporting electrical connectors which are connectable to flat, multi-conductor cable; said electrical connectors each comprising: an elongated insulation body of rectangular section, one side of said body having a generally flat surface having spaced contacts, adapted for piercing the insulation sheath of a flat multi-conductor cable and making engagement with respective conduction of said cable, the other side of said body having respective electrical conductors connected to respective ones of said contacts, said conductors being accessible for connection at said other side of said body; a cover member having a flat cover section and a pair of legs extending from the opposite ends of said cover member and disposed in spaced parallel planes which are perpendicular to the plane of said flat cover section; means for holding said cover member on said body; said tray comprising a thin plastic-molded sheet having a plurality of parallel troughs; each of said troughs comprising a flat base and a pair of upstanding walls extending from said base; the depth of each of said troughs being substantially equal to the thickness of said body and of said cover member; the length of said troughs being greater than the length of at least one of said connectors; the width of said troughs being equal to the distance between the free end of either said contacts or said conductors, and the outer surface of said cover member when said cover member is placed over said body; said tray having respective thin flat elongated ledges connecting the adjacent sides of said parallel troughs;

said tray being asymmetric about a central line which extends parallel to said troughs and whereby the bottom of said troughs of an upper tray of a stack of said trays seats atop respective ones of said flat ledges of a lower tray of said stack; alternate trays in said stack being rotated 180° relative to their respective center lines.

11. The tray of claim 10 which includes a reinforcement ledge extending around the periphery of said tray and disposed in the plane of said elongated ledges.

12. The tray of claim 11, wherein the widths of the opposite lateral portions of said reinforcement ledge are different from one another to produce the asymmetry of said tray about its said center line.

* * * * *